US006634967B2

(12) United States Patent
Daniel

(10) Patent No.: US 6,634,967 B2
(45) Date of Patent: Oct. 21, 2003

(54) BASEBALL UMPIRING SYSTEM

(76) Inventor: Benjamin S Daniel, 1053 Columbia Ave., Chicago, IL (US) 60626

( * ) Notice: Subject to any disclaimer, the term of this patent is extended or adjusted under 35 U.S.C. 154(b) by 0 days.

(21) Appl. No.: 10/151,535

(22) Filed: May 21, 2002

(65) Prior Publication Data

US 2002/0169038 A1 Nov. 14, 2002

Related U.S. Application Data

(63) Continuation-in-part of application No. 09/665,003, filed on Sep. 19, 2000, now abandoned.

(51) Int. Cl.[7] ..... A63B 71/06
(52) U.S. Cl. ..... 473/451; 473/467
(58) Field of Search ..... 473/451, 455, 473/467, 142; 348/143, 153, 154, 155, 157, 159, 169

(56) References Cited

U.S. PATENT DOCUMENTS 4,545,576 A * 10/1985 Harris ..... 473/351
5,600,368 A * 2/1997 Matthews, III ..... 348/143
5,768,151 A * 6/1998 Lowy et al. ..... 348/157
6,042,492 A * 3/2000 Baum ..... 473/453
6,100,925 A * 8/2000 Rosser et al. ..... 348/169
6,133,946 A * 10/2000 Cavallaro et al. ..... 348/135

FOREIGN PATENT DOCUMENTS

JP 409290037 A * 11/1997 ..... A63B/71/06

* cited by examiner

*Primary Examiner*—Jessica Harrison
(74) *Attorney, Agent, or Firm*—Paul H. Gallagher

(57) ABSTRACT

A T.V camera in center field beyond the playing field directed at the home plate along a main axis. The camera senses the baseball in the strike zone. A second T.V. camera directed at the home plate in direction perpendicular to the main axis, which also senses the baseball in the strike zone, but in an area between the front end limits of the home plate. The two T.V. cameras are connected in series and serve to control the scoreboard and show on the scoreboard when the baseball in its passage by the strike zone constitutes a strike.

4 Claims, 2 Drawing Sheets

10
12
14
16
17
18
20
21
22
24
26
28
29
30
30'
31
31'
32
34

BASEBALL UMPIRING SYSTEM

This is a continuation-in-part of my prior and presently abandoned application Ser. No. 09/665,003, filed Sep. 19, 2000.

FIELD OF THE INVENTION

The invention resides in the field of umpiring in baseball, and particularly the use of electronic detection of pitched balls in the strike zone.

SUMMARY OF THE INVENTION

As is well known, in baseball games, there are many arguments about whether a pitched ball is a strike or a ball, and in those cases the resulting decision is a judgment call, which many times leaves bad feelings among the persons involved and among the fans. A main object of the invention therefore is to provide electronic means for sensing the movement of the pitched balls over the home plate, to determine whether a pitch is a strike or a ball.

Another object is to register the strikes on the score board, in response to sensing the baseball at the home plate, without the requirement for any further manual manipulation.

A further object is to eliminate the need for the presence of an umpire at the home plate.

BRIEF DESCRIPTION OF THE INDIVIDUAL FIGURES OF THE DRAWINGS

DETAILED DESCRIPTION OF THE DRAWINGS

Figure 1:
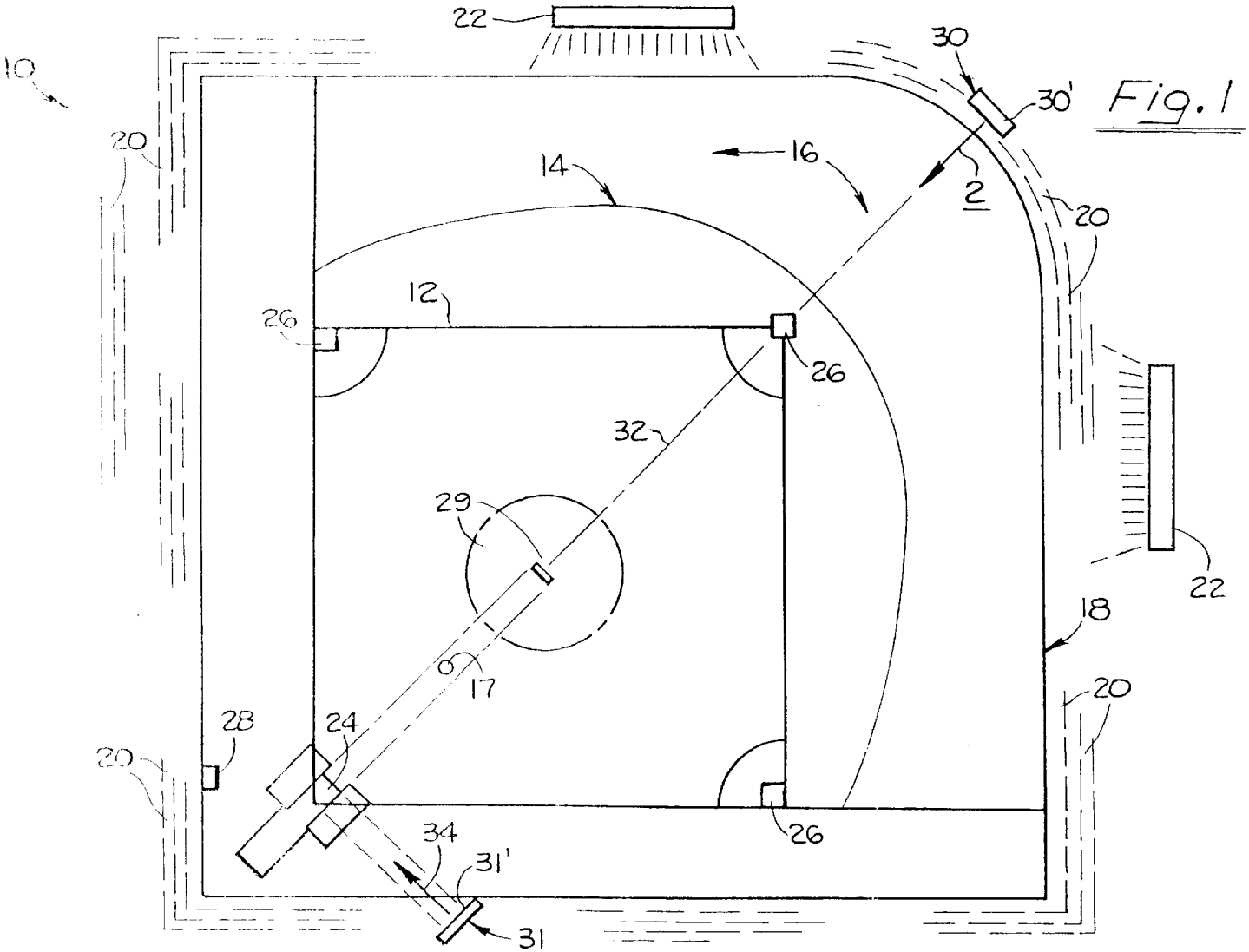
FIG. 1 is a plan view of a baseball field, with certain parts in exaggerated dimensions.

FIG. 1 is a semi-diagrammatic plan view of a baseball field. Various details are omitted, for the sake of simplicity, but because of the general knowledge of baseball, by the public, it is believed unnecessary to refer to all details.

As used herein, the word system includes apparatus, method, and functions of the apparatus and the components thereof.

The baseball field is indicated at 10 and includes the diamond 12, the infield 14, and the outfield 16. A baseball appears at 17, a fence at 18 defines the outer limits of the outfield, and outwardly beyond the outfield are the seats 20. Score boards 22 are shown diagrammatically and these are so located that all of the spectators have a view of at least one of them, if not both.

On the diamond 12 are the home plate 24, and the first, second, and third bases 26, and the pitcher's mound 29. A stand 28 is positioned behind the catcher, for holding a supply of extra baseballs for individual accessibility to the catcher. It is pointed out that there is no need for an umpire at the home plate.

T.V. camera units 30 and 31 are included in FIG. 1, a first unit 30 being located in the center field structure, and a second unit 31 being located in the right field stands. These units are shown diagrammatically, and each includes a mechanical structure and a camera therein, the cameras being identified 30',31' respectively. The first unit 30 is positioned for the camera 30' therein to view along a diagonal line 32 forming a main axis, extending from center field, through the second base, the pitchers mound, and the strike zone over the home plate identified below.

The second camera 31' in the unit 31 is arranged for viewing along a line 34, forming a secondary axis, transverse, and preferably perpendicular, to the main axis or diagonal line 32. This secondary axis 34 also passes through the strike zone over the home plate.

The T.V. camera units 30 and 31 are known items that are presently on the market. They are generally included in surveillance equipment and used for example for viewing an area to determine whether an article or person occurs or appears in that area, in the scope of the unit.

Such units are also known as motion detectors in surveillance equipment and upon the appearance of a person or object in the area concerned, produce a signal, most often an electrical signal, for turning on a light constituting a message to the observing personnel. Such an electrical signal is well adapted to the system of the present invention, where a light is utilized in the scoreboard, and that may be the same signal, or it might be relayed to a subsequent signal that is reproduced in the scoreboard. In any case, while an electrical signal is a preferred form of signal, the invention is not limited to that kind of signal.

Such units have certain internal and innate attributes to sense an article or item occurring in the scope of the unit, that is of a certain shape, and when such an article is so sensed, a signal is produced in the unit that is utilized for in turn producing a certain function, such as turning on a switch, or turning it off. In the present case, such a switch is turned on, which controls the turning on of a light in the scoreboard, to indicate a strike.

The strike zone referred to is established above the home plate within the area surrounded by the vertical planes containing the edges of the home plate, and between the knees and the chest of the batter, and extending horizontally through the length of the home plate along the line 32.

Figure 2:
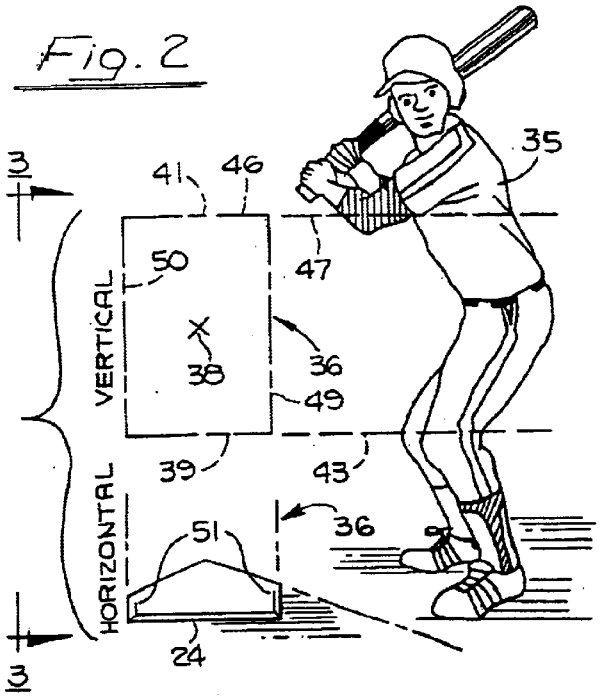
FIG. 2 is a diagrammatic view oriented according to the arrow 2 at the upper right corner of FIG. 1.

FIG. 2 is a view taken in the direction of the arrow 2 at the upper right hand corner of FIG. 1, and showing a right-handed batter 35. The strike zone is indicated at 36 and as here shown, is in the shape of a rectangle, of which the center is indicated at 38. The representation 36 is a vertical plane suspended above the ground and extending transverse to the main axis 32. The strike zone extends vertically through a range between a lower edge 39 and an upper edge 41. The lower edge is at knee height as indicated by the line 43 which is an extension of the line 39, extending to the knees of the batter. The upper edge of thestrike zone is determined by the line 46 which, as projected by the line 47, extends to the chest of the batter.

The lines 49, 50 determine the side edges of the strike zone, these lines lying in vertical planes that contain the side edges 51 of the home plate 24, the latter being shown in FIG. 2 in horizontal position.

Figure 3:
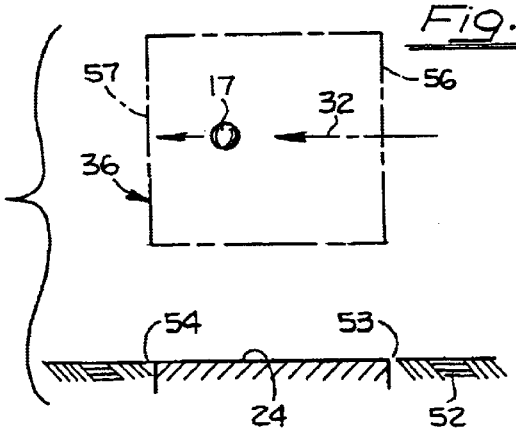
FIG. 3 is a diagrammatic view oriented according to the line 3—3 of FIG. 2.

FIG. 3 is a view taken from the left of FIG. 2, resulting from its being taken along the transverse axis or line 34 of FIG. 1. In FIG. 3 the home plate 24 is shown on, or in, the ground 52 and its front and rear edges are indicated at 53, 54.

In further description of the strike zone 36 (FIG. 3), it includes vertical lines 56, 57 representing the front and rear ends. The strike zone is of course of the same height as that described in connection with FIG. 2, but is of the length of the plate, i.e. along the main axis 32, and thus of greater length than width.

Figure 4:
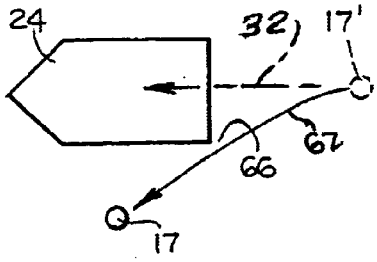
FIG. 4 is a diagrammatic view looking down on the home plate and showing a curve ball missing the strike zone.

In considering the limits or boundaries of the strike zone, it is of cubic dimensions or 3-dimensional shape, and must be vertically within the space between the knees and chest of the batter, and in longitudinal and transverse directions within the limits of the home plate. Thus for a pitched ball to be in the strike zone it must be within the limits of that cubic space. On this point consideration is given to a pitched curve ball moving along the line 67 (FIG. 4) approaching the home plate, and nearly reaching it but turning away before reaching it, as represented by the space 66 FIG. 4. The first camera 30', which is directed along the main axis 32 views the baseball at position 17' (FIG. 4) and thus registers the ball as passing through the strike zone, represented by the home plate 24. The ball would miss the plate (at 66), and the strike zone, and to avoid inaccuracies that would result from this condition, the second T.V. camera 31' is provided. This camera is directed along the line 34 (FIGS. 1&5) referred to above, but is directed downwardly also, to show the space 66 throughout the length of the strike zone.

As a consequence of the three dimensional shape of the strike zone, the cameras all are energized simultaneously to include the three directions of the ball relative to the strike zone.

Figure 5:
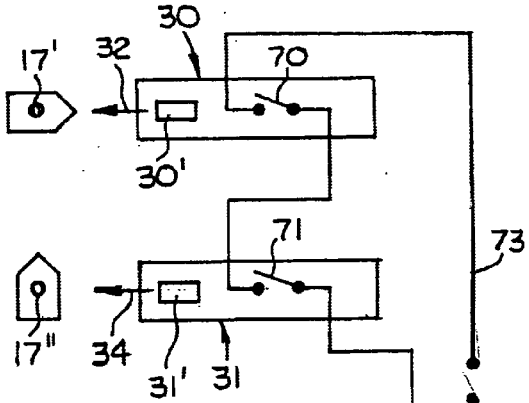
FIG. 5 is a diagrammatic view showing a baseball in the strike zone, from two different angles.

FIG. 5 includes the TV camera units 30,31 directed at the strike zone as indicated by the axes 32,34, here shown as arrows. Incorporated in the units 30,31 are switches 70,71 in series in a circuit 73 for controlling the intended signal to the scoreboard. From this circuit (FIG. 5) it will be seen that when the baseball is in the strike zone, both cameras 30", 31" will transmit signals and form a single, final signal transmitted to the scoreboard.

The cameras may be considered as remote control units and when the baseball is in the range of either of the cameras, the corresponding switch 70, 71 is closed thereby.

In this case the first camera is directed along the diagonal main axis, and the second camera along the axis 34, and not only is it directed transversely, but also downwardly at such an angle as to scan the strike zone to detect the space 66 between the home plate 24 and the line of movement 67 of the ball.

While the various presently known motion detectors, such as 30,31 are designed for detecting objects of different shapes, those that detect only balls or spheres will be satisfactory for use in the apparatus of the present invention since only the detection of a baseball is utilized.

Figure 6:
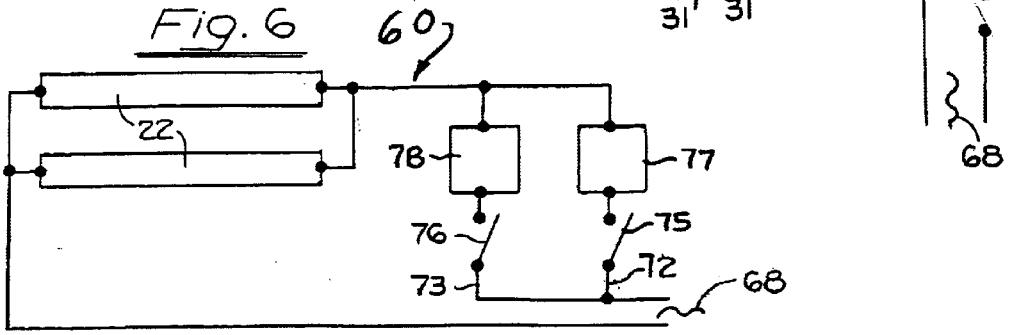
FIG. 6 shows a manual switch for indicating a ball.

As will be understood, in the case of a pitched ball passing through the strike zone, a strike will be automatically recorded on the scoreboard but, when it misses the strike zone, a ball is not automatically recorded. Many times in regular games, balls are not indicated by the umpire, but if it is desired to record the balls as well as the strikes, an arrangement such as shown in FIG. 6 may be utilized. In this case, a manual switch 75 leads from the electrical source 68, and separates indicators are included in the scoreboard for showing balls. The arrangement of FIG. 6 may be used in a conventional game, as well, if desired. In this case, the electrical source 68 is provided with lines 72,73 having switches 75, 76 leading to components 77, 78 in parallel, controlling ball and strike signals respectively. The lines continue to the scoreboards 22, and a common line 77 returns to the source 68

In the case of a ball, the operator actuates the switch 75 to provide the ball signal, but in the case of a strike, the signal need not be manually produced.

FIG. 6 shows the scoreboards 22 which may be considered as one instrumentally, since they both are operated identically and simultaneously. Circuitry 60 includes the scoreboards arranged in series with the switches 77, 78. In FIG. 5 a baseball is diagrammatically illustrated at 17', 17", as being viewed by both cameras 30', 31'.

I claim:

1. A system of umpiring in a baseball game in a conventional baseball field having a scoreboard, the scoreboard being of known kind having electrically controlled signal means indicating strikes, main circuitry in the scoreboard operable for energizing the signal means, the system including apparatus made up of a plurality of components arranged relative to a strike zone constituted by a volumetric space above the home plate and defined by peripherally arranged vertical planes containing the corresponding edges of the home plate and extending vertically between the knees and chest of a batter, the apparatus including two, and only two, T.V. units of known kind, the T.V. units constituting a first T.V. unit and a second T.V. unit, and the T.V. units including first and second cameras, respectively, the first T.V. unit and camera being located in center field and directed on a main axis extending diagonally across the baseball field, over the second base, pitcher's mound and through the strike zone, the second T.V. unit and camera being located angularly spaced from the first T.V. unit, and itself, and the second camera therein, being directed on a second axis extending transverse to the main axis, and through the strike zone, the T.V. units and the cameras therein being capable of sensing an object within a predetermined scope of the corresponding T.V. units and cameras, which includes the strike zone, in both the directions along the respective axes and transverse thereto, a first electrical control circuit in the first T.V. unit and capable of being energized in response to that T.V. unit sensing a baseball in the strike zone, a second electrical control circuit in the second T.V. unit and capable of being energized in response to that T.V. unit sensing a baseball in the strike zone, a connector circuit operably connecting said control circuits together in series, and to said main circuitry, the control circuits being inactive in the absence of a baseball in the strike zone, whereby the control circuits, together, when energized, are capable of energizing the main circuitry, and thereby the signal means, the T.V. units being incapable of control by manual control steps, whereby the entire apparatus is incapable of operation in the absence of a baseball in the strike zone.

2. A system of umpiring according to claim 1, wherein, said axes are perpendicular to each other.

3. A system of umpiring according to claim 2, wherein, the second T.V. unit is also directed downwardly to record a pitched ball that misses the strike zone in direction laterally of the strike zone relative to said first axis.

4. A system of umpiring according to claim 1, wherein, the elements recited in claim 1 constitute a first phase wherein the functioning of the elements therein proceeds without any manual manipulation, and the system includes a second phase for signaling balls instead of strikes, the scoreboard includes a second signal means for indicating balls, and the system includes manually actuated switch means for energizing the second signal means.

* * * * *